United States Patent [19]

Campbell et al.

[11] Patent Number: 4,565,252

[45] Date of Patent: Jan. 21, 1986

[54] BOREHOLE OPERATING TOOL WITH FLUID CIRCULATION THROUGH ARMS

[75] Inventors: Thomas R. Campbell; William L. Cunningham; Gregg S. Perkin, all of Kingwood, Tex.

[73] Assignee: LOR, Inc., Houston, Tex.

[21] Appl. No.: 587,501

[22] Filed: Mar. 8, 1984

[51] Int. Cl.[4] ..... E21B 10/32

[52] U.S. Cl. ..... 175/269

[58] Field of Search ..... 175/263, 267, 269, 290–292, 175/340, 344, 406

[56] References Cited

U.S. PATENT DOCUMENTS

| | | |
|---|---|---|
| 1,478,306 | 12/1923 | Sweetman . |
| 1,678,075 | 7/1928 | Phipps . |
| 1,752,092 | 3/1930 | Kapeluchnikoff . |
| 1,997,436 | 4/1935 | Seay . |
| 2,069,482 | 4/1935 | Seay . |
| 2,072,859 | 3/1937 | Grant . |
| 2,238,895 | 4/1941 | Gage . |
| 2,284,170 | 5/1942 | Santiago . |
| 2,344,598 | 3/1944 | Church . |
| 2,544,623 | 3/1951 | Weiler . |
| 2,690,897 | 10/1954 | Clark, Jr. . |
| 2,755,071 | 7/1956 | Kammerer . |
| 2,790,625 | 4/1957 | Dean . |
| 2,847,189 | 8/1958 | Shook . |
| 2,872,160 | 2/1959 | Barg . |
| 3,016,099 | 1/1962 | Woodruff . |
| 3,224,507 | 12/1965 | Cardary et al. . |
| 3,295,604 | 1/1967 | Cardary et al. . |
| 3,351,144 | 11/1967 | Park . |
| 3,363,706 | 1/1968 | Feenstra . |
| 3,386,521 | 11/1965 | Chadderdon . |
| 3,425,500 | 2/1969 | Fuchs . |
| 3,554,305 | 1/1971 | Kammerer, Jr. . |
| 3,575,245 | 4/1971 | Cordary . |
| 3,685,601 | 8/1972 | Hollingshead . |
| 3,712,854 | 1/1973 | Thometz . |
| 3,757,877 | 12/1971 | Leathers . |
| 3,817,339 | 6/1974 | Furse . |
| 3,823,789 | 7/1974 | Garner . |
| 3,949,820 | 4/1976 | Furse . |
| 4,036,314 | 7/1977 | Dixon . |
| 4,055,226 | 10/1977 | Weber . |
| 4,064,951 | 12/1977 | Weber . |
| 4,091,883 | 5/1978 | Weber . |
| 4,187,920 | 2/1980 | Johnson . |
| 4,195,701 | 4/1980 | Kellner et al. . |
| 4,222,447 | 9/1980 | Cholet . |
| 4,246,977 | 1/1981 | Allen . |
| 4,282,941 | 8/1981 | Perkin . |
| 4,282,942 | 8/1981 | Longmore . |
| 4,303,136 | 12/1981 | Ball . |
| 4,401,171 | 8/1983 | Fuchs ..... 175/267 |
| 4,461,361 | 7/1984 | Fuchs ..... 175/269 |

OTHER PUBLICATIONS

1984 Product Catalog.

*Primary Examiner*—Stephen J. Novosad
*Assistant Examiner*—William P. Neuder
*Attorney, Agent, or Firm*—Pravel, Gambrell, Hewitt & Kimball

[57] ABSTRACT

A borehole operating tool such as an underreamer or milling tool for performing borehole expanding or cutting operations in an oil well borehole, the tool including an elongated cylindrical housing having a main bore and side openings in which expandable arms are mounted for pivotal movement between closed and opened positions by a pivot pin; a piston element is mounted within the main bore of the housing for moving to an actuated position holding the expandable arms in an outer, expanded position; and a rotary fluid housing is mounted within each expandable arm about the hinge pin and includes a body nozzle for receiving fluid from the body and an expandable arm nozzle for directing fluid into a bore which extends through the expandable arm to thereby provide circulating fluid outwardly of the expandable arm in order to keep the operating outer end area of the expandable arm from becoming clogged.

12 Claims, 5 Drawing Figures

BOREHOLE OPERATING TOOL WITH FLUID CIRCULATION THROUGH ARMS

TECHNICAL FIELD OF THE INVENTION

This invention relates to borehole operating tools such as underreamers and milling tools for utilization in oil well drilling operations to enlarge boreholes or to mill casing wherein the tools include expandable arms.

BACKGROUND OF THE INVENTION

Underreamers are a type of borehole operating tool for use in enlarging the borehole in an oil well or mine, which borehole was initially bored by the drill bit. A typical underreamer includes expandable arms mounted in a housing by suitable hinge pins for movement between a withdrawn or closed position and an open, expanded position. Typically, the expandable arms are moved outwardly by means of a pressure actuated piston mounted within the main bore of the tool housing. In one type of underreamer, the expandable arms have mounted on the end, rotating cone bits for engaging certain types of formation and enlarging a borehole. Another type of underreamer is known as the "drag-type". In the drag-type underreamer, the expandable arms have a machined surface which is typically coated with a hardfacing material for engaging and expanding a borehole after the initial bore has been cut by a drill bit, or, such machined surface may have diamond bit implants such as manufactured by General Electric under the trademark "Stratapax". In oil well drilling application, these tools are mounted at the end of the drill string, except in the case of a drilling type underreamer, which is mounted in the drill string above the drill bit. One use of underreamers is to expand the size of the borehole in order to allow additional space for cementing operations or gravel packing. Another type of oil well drilling tool which utilizes expandable arms is a milling tool. In a milling tool, the arms are moved to an expanded position in order to engage casing, which is a steel tubing inserted into and used to encase the borehole, in order to cut the casing as needed. For the purposes of discussion here, these various tools, underreamers and milling tools, are referred to as borehole operating tools.

Such borehole operating tools used as underreamers engage the actual earth formation and cut a larger hole than created by the drill bit. In such a cutting operation, the cutter cones or hardened end of the expandable arms actually engage the formation and cut into the formation thus creating drill cuttings and formation pieces which need to be removed from the cutting area in order to make the cutting operation efficient. Cuttings from the formation need to be continually removed in order to keep the cutter element, whether it be a rotating cutter cone or a hardened outer end of the expandable arm, relatively free of debris and relatively clean and cool to enhance further cutting.

One means of keeping the cutter elements and the outer end of the expandable arms relatively free of debris is provided by providing nozzles in the tool body for spraying fluid outwardly at the cutter elements or the outer end of the expandable arms. As is well-known in the art of drilling oil wells, drilling fluid is circulated down through the drill string and returned upwardly in the annular area between the drill string and the wall of the borehole itself. Such fluid sprayed outwardly of the borehole operating tool body enhances circulation of cuttings made by the cutter elements of the tool arms upwardly in the annulus area. It has also been suggested and disclosed in certain patents that the expandable arms have one or more nozzles to spray fluid outwardly of the arms themselves; however, the problem of an effective fluid transfer from the underreamer body to the underreamers arms remains to be solved.

SUMMARY OF THE INVENTION

It is an object of this invention to provide a borehole operating tool such as an underreamer wherein an improved fluid connection is provided between the tool housing and the expandable arms. Such a borehole operating tool includes an elongated generally cylindrical body having a main bore and a plurality of circumferentially spaced lateral openings to receive expandable arms. The body also has a plurality of circumferentially spaced directional chambers or bores which extend from fluid communication with the main bore to the lateral body openings. Means are provided for mounting the expandable arms for movement between a closed position and an outer, operating position wherein cutter elements or cutting surfaces located at the outer ends of the expandable arms engage the earth and, due to rotation of the drill string, enlarge the borehole. Means are provided for engaging the expandable arms and holding the expandable arms in an outer, expanded position. Each of the expandable arms has a bore therein which extends from a first end of the expandable arm and terminates substantially at the second, outer end of the arm. Rotary fluid transfer means are mounted with the body in fluid communication with the circumferentially spaced directional chambers and with the first end of each expandable arm about the pivot means for directing fluid from the main body bore, through the circumferentially spaced directional chambers and into the bore of the expandable arms for directing fluid outwardly of the expandable arms in order to deliver fluid under pressure to the operating end of the expandable arms and to help prevent clogging of the area in which the expandable arms operate.

This summary of the invention is not intended to set out all the patentable features of the invention but is merely intended to generally describe the invention. The specification to follow will set out the preferred embodiment and the claims will set out the patentable features.

DESCRIPTION OF THE PREFERRED EMBODIMENT

Figure 1A:
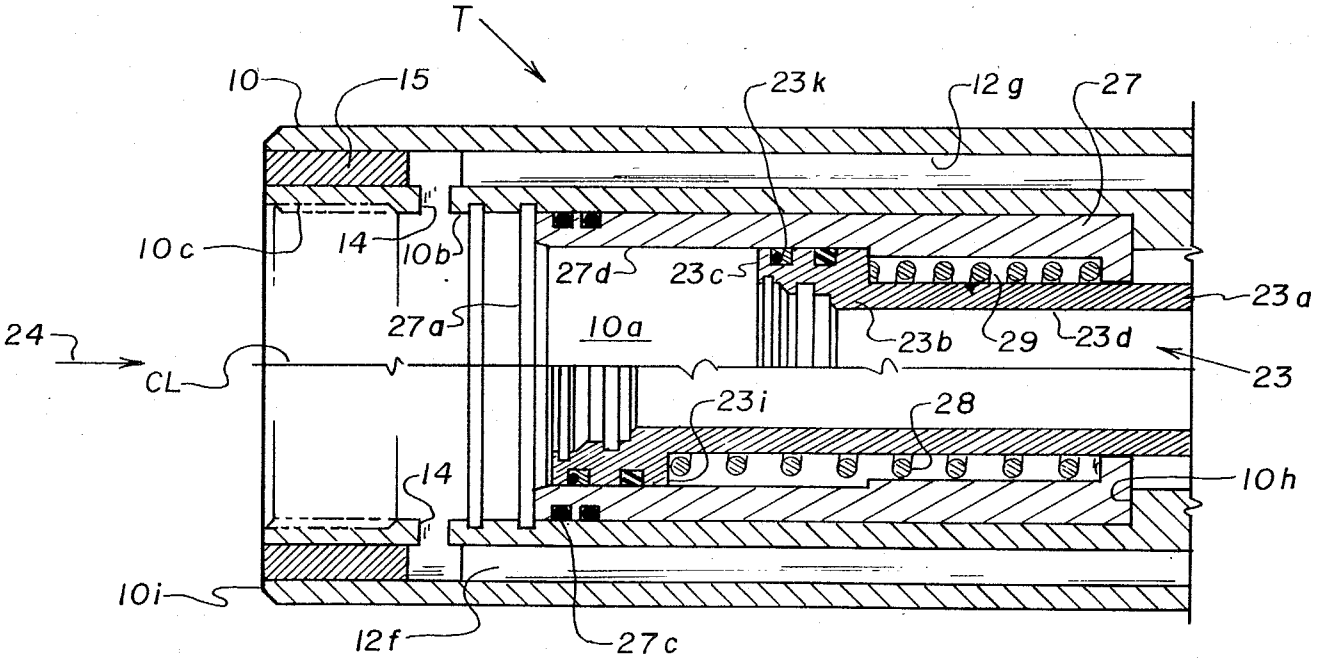
FIGS. 1A and 1B are sectional views of the borehole operating tool of this invention, the top portion of each view showing an expandable cutter arm in its actuated, expanded position and the bottom portion of each view showing an expandable arm in its initial, withdrawn position.

Referring to the drawings, the borehole tool T of the preferred embodiment of this invention is designed to be used in oil well drilling operations or other operations such as mining wherein it is necessary to drill and thereafter enlarge a borehole. In the oil well drilling art, such borehole tools T include roller-type and drag-type underreamers. Typically, roller-type underreamers include expandable arms having rotary cutter elements mounted on the outer end of the expandable arms for engaging the formation and enlarging a borehole. Drag-type underreamer arms have machined outer ends which are expanded into the formation for cutting the formation. Such outer ends of the expandable arms on drag-type underreamers are typically machined and have hardened surfaces or have hardened bit inserts implanted to provide greater cutting and wear characteristics. It is further included within the scope of the borehole tool T of this invention to utilize the tool T for milling operations in oil well drilling. In milling operations, the borehole tool T, having expandable cutter blades in place of underreamer arms, is inserted into the borehole for the purpose of cutting outer steel casing or performing other milling or cutting operations within the confines of the borehole. For the purpose of this invention, all such tools shall be considered as "borehole operating tools".

Referring to FIG. 1, the borehole tool T particularly illustrated is a drag-type underreamer wherein the expandable arms include hardened surface areas or surface areas implanted with hardened bit inserts to increase the wear characteristics of the arms. The term "borehole" as used herein will include a bore which has been drilled into the earth's formation and has earth sides, which can be rock, shale or other formation, and which may need to be enlarged utilizing the tool T of this invention. Further, "borehole" will include a bore having steel casing already positioned therein. It may be that the borehole tool T has other applications analogous to those specifically discussed and it is within the scope of this invention to apply the borehole tool T in all such fields.

Figure 1B:
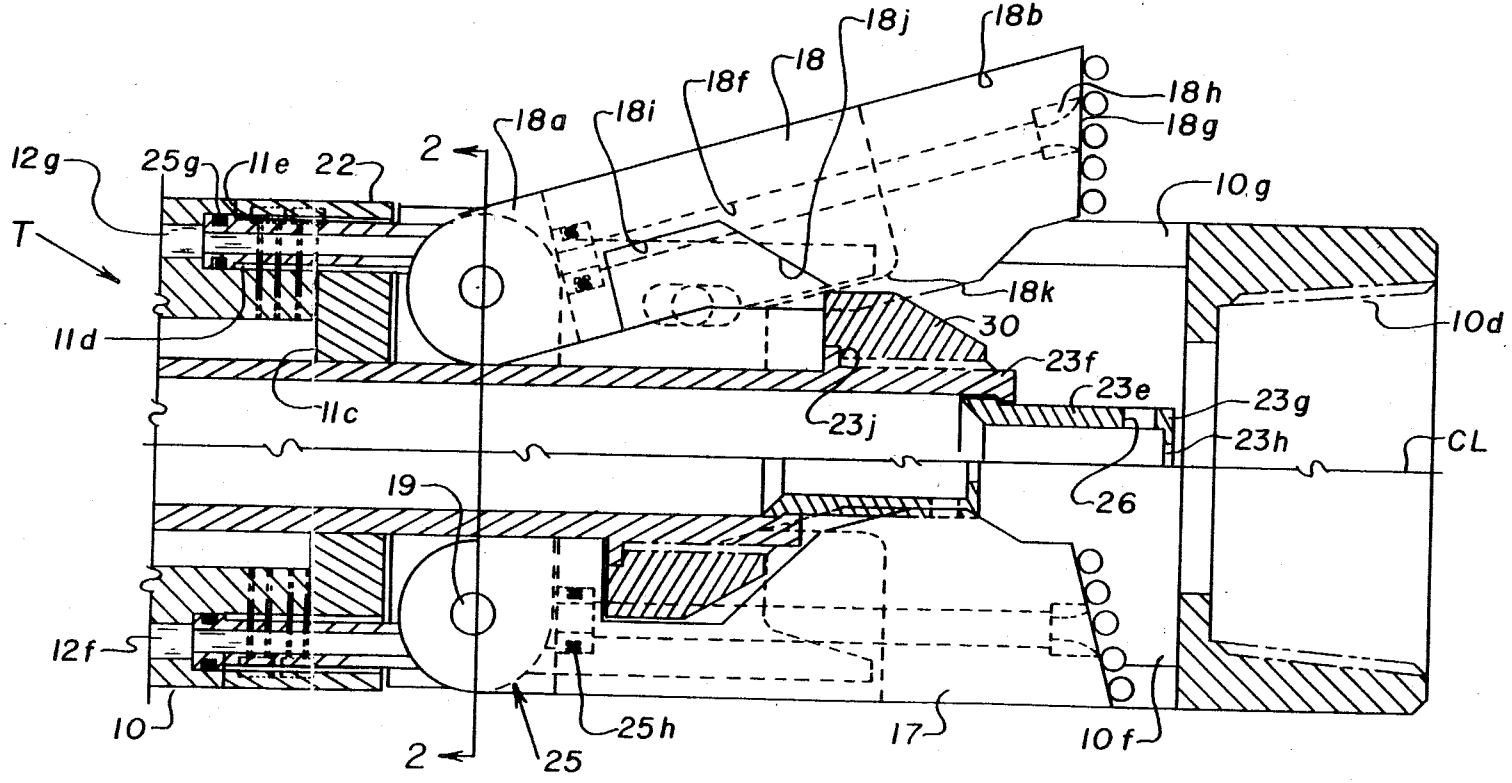

Referring now to FIGS. 1A and 1B, the borehole tool T of the preferred embodiment of this invention includes an elongated substantially cylindrical housing 10 which has a main bore 10*a* defined by an internal, cylindrical wall 10*b*. The main, cylindrical bore 10*a* extends through the entire housing. The upper end of the main bore identified as 10*c* may have suitable threads to connect the tool T into a drill string, which, as known in the oil well drilling field, is a series of drill pipes which extend from the surface operating rig to the bottom of the hole terminating in a drill bit. The bottom of the tool T may also terminate in an interiorly threaded area at 10*d* for the purpose of completing the threaded connection of the tool T within the drill string. Typically, in oil well drilling applications, drilling fluid is circulated from the surface drill rig, downwardly through the drill string and outwardly around the rotating drill bit. Drilling fluid is circulated upwardly from the bottom of the hole in the annular area between the drill string and the borehole which has been bored by the drill bit. It is necessary to circulate drilling fluid through the drill string and upwardly in the annulus between the drill string and the borehole in order to wash away from the bottom drill cuttings and thus keep the bottom of the hole clear for further drilling. One of the substantial uses of the borehole tool T of this invention as an underreamer is to enlarge boreholes which have been drilled utilizing a standard drill bit.

Figure 2:
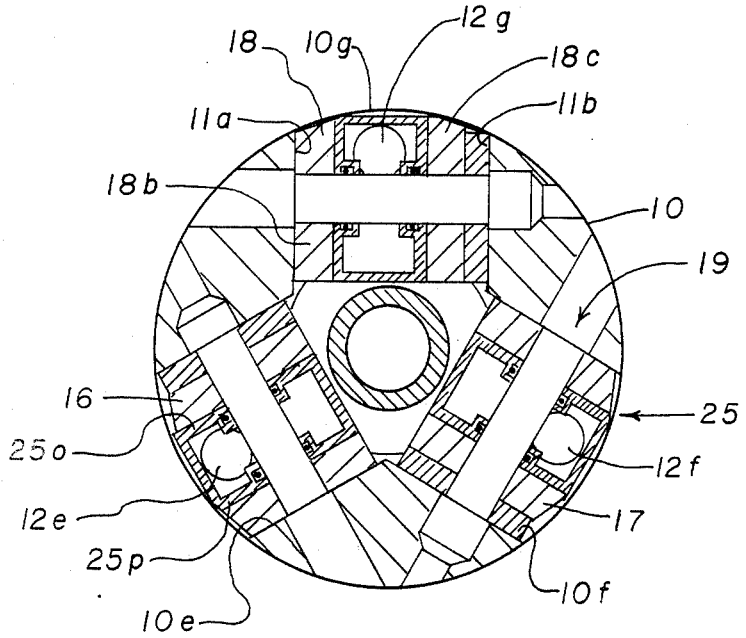
FIG. 2 is a sectional view taken along line 2—2 of FIG. 1 illustrating a rotary fluid transfer means mounted in position about the expandable arm hinge pin.

Referring to FIGS. 1B and 2, the body 10 of the borehole tool T includes three circumferentially spaced openings 10*e*, 10*f*, and 10*g* machined into the body T just above the bottom portion 10*d* of the tool. FIG. 2 shows a section through all three of the circumferentially spaced openings, which are 120° apart.

In FIGS. 1A and 1B, the top part of the section drawing above center line CL discloses only opening 10*g*, it being understood that the structure to be described herein as applied to opening 10*g* applies identically to openings 10*e* and *f*. For the purposes of explanation, the bottom portion of the sectional view of FIGS. 1A and 1B below centerline CL also discloses opening 10*f*. Thus the bottom portion below center line CL of FIGS. 1A and 1B is, while a similar side sectional view, taken 120° from the plane of the sectional view above center line CL. However, the actual structure to be described with respect to the sectional view both above and below the center line CL is identical for each of the openings and thus hereinafter the same identification will be used for the same elements, it being understood that the same structure is located in each opening 10*e–g*.

Each of the three openings 10*e*, 10*f*, and 10*g* is basically an elongated rectangular opening having the straight walls as illustrated in FIG. 2. The straight side walls for opening 10*g* are identified in FIG. 2 as 11*a* and 11*b*. Further, referring to FIG. 1B, the opening 10*g* terminates at its upper end in a first radially directed shoulder 11*c*, which extends outwardly to a second longitudinally or axially directed shoulder or face 11*d* which extends upwardly and terminates in a third radially directed shoulder 11*e*.

The body 10 includes three, circumferentially spaced directional chambers or directional bores 12*e*, 12*f*, and 12*g*. Referring to FIG. 2 and the top half of the sectional view of FIGS. 1A and 1B, the directional chamber or bore 12*g* is illustrated as being machined or drilled into the body 10 from the upper or top edge of the tool at 10*i* downwardly into the opening 10*g*, terminating at radial shoulder 11*e* at the top of the opening 10*g*. Similarly, the directional chamber 12*f* extends from upper tool edge 10*i* downwardly through the body of the tool and terminates in a radially directed shoulder 11*e* for opening 10*f*. In this manner the directional chambers or bores 12*f* and 12*g* are aligned with the respective body lateral openings 10*f* and 10*g*. Similarly, the directional bore 12*e* is aligned with the lateral body opening 10*e*. Each of the directional bores or chambers 12*e–g* are thus circumferentially spaced 120° apart just as are the body openings 10*e–g* and are aligned with the openings to deliver fluid flow into the area of the openings 10*e–g*. Three radial ports 14 (only two of which are shown in FIG. 1A) are machined into the interior cylindrical wall 10*b* of the body 10 in order to provide fluid communication from the interior bore 10*a* of the body 10 into each of the directional chambers or bores 12*e–g*. Each of the directional bores 12*e–g* are plugged with a steel plug 15 topped with weld material to effectively seal off the top of the bores so that all fluid enters through the openings 14 in the interior wall 10*b* of the body 10.

Referring to FIGS. 1A, 1B, and 2, expandable arms 16, 17, and 18 are mounted, respectively, in lateral body openings 10*e*, 10*f*, and 10*g* for movement between the initial, withdrawn position illustrated in the bottom portion of FIGS. 1A and 1B and the outer, expanded or actuated position illustrated in the upper portion of the sectional view of FIGS. 1A and 1B. Each of the expandable arms 16–18 are mounted for movement between the initial and the expanded positions by a pivot means generally designated as 19. The pivot means 19 is mounted with the body 10 and with the expandable arms 16–18 in the lateral body openings 10*e*, 10*f*, and 10*g* to provide for movement of the expandable arms between the initial, closed position and the expanded position. Further, a rotary fluid transfer means generally designated as 25 is mounted with the body 10 in fluid communication with the circumferentially spaced directional chambers 12*e*, *f*, and *g* about the pivot means 19 for directing fluid from the directional chambers or bores into bores such as 18*f* in the expandable arms 16–18. Since the structure of each of the expandable arms 16–18 as well as the pivot means 19 and the rotary fluid transfer means 25 for each of the arms 16–18 is identical, the same identification numbers and letters will be utilized to identify all identical parts and features.

Each of the expandable arms 16–18 are elongated members, generally rectangular in cross-section, having a first or inner end 18*a* and a second or outer, operating end 18*b*. The outer, operating end 18*b* illustrated in FIGS. 1A and 1B has the machined, hardened surface of a drag-type underreamer arm. In the embodiment illustrated, the drag-type underreamer arm has an outer, hardened surface implanted with the cutting bit elements manufactured under the trademark Stratapax by General Electric Corporation. It should be understood that other hardfacing surface materials or implants known in the art may also be utilized. Additionally, if the borehole tool T of this invention is a rock-type underreamer, then the outer end 18*a* of the arm 18 will have mounted thereon a rotatable, cutting cone for cutting into the earth's formation to enlarge a borehole. Either of such types of underreamers cutter arms may be utilized in the borehole tool T of this invention. It should be further understood that the arm 18 may have a machined cutting surface for the purpose of utilizing the borehole tool T as a milling tool as previously described.

Figure 3:
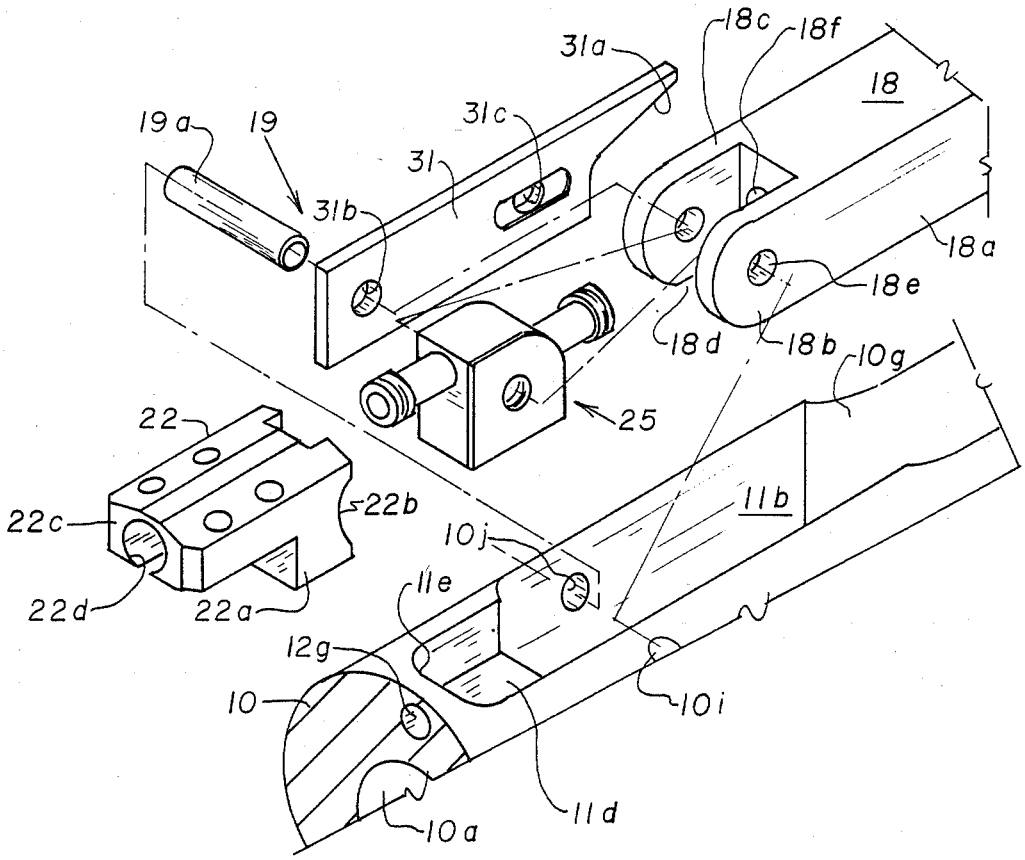
FIG. 3 is a perspective, exploded assembly view of the mounting of the rotary fluid transfer means in the expandable arm and tool body.
Figure 4:
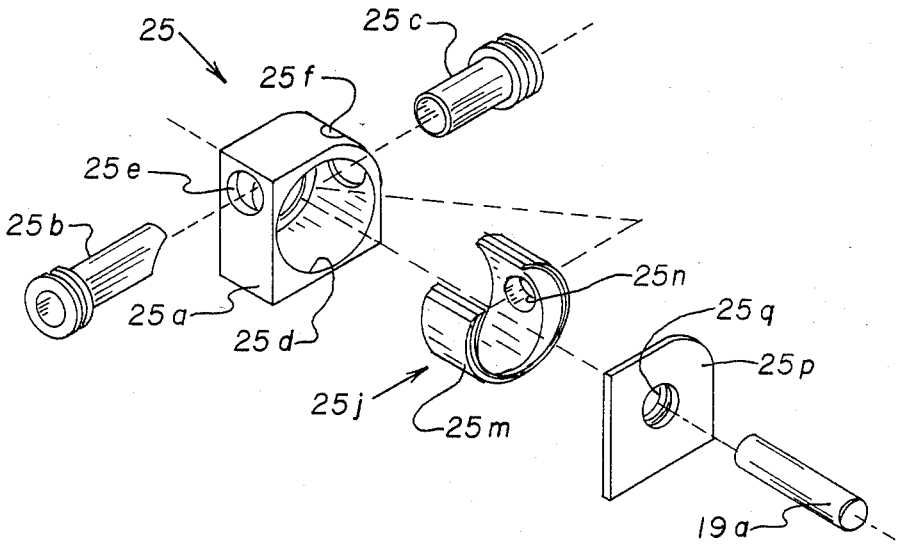
FIG. 4 is an exploded view in perspective of the components of the rotary fluid transfer means of this invention.

Each of the expandable arms 16–18 is generally U-shaped at inner end 18*a*. Referring in particular to FIGS. 2 and 3, the inner end 18*a* of the expandable cutter arm 18 includes opposing yoke sections 18*b* and 18*c* which are spaced apart by a rectangular recess 18*d*. Each of the yoke sections 18*b* and 18*c* has an opening 18*e* for receiving a hinge pin 19*a* which extends through the openings into pin mounting bores 10*i* and 10*j* in the sides 11*a* and 11*b*, respectively, of each lateral body opening such as 10*g*. The hinge pin is held in position by suitable means and thus serves as the pivot means 19 for mounting the expandable arms 16–18 for pivotal movement.

A mounting lug 22, which is generally L-shaped, is mounted with the body 10 above the expandable arms such as 18 in order to receive the brunt of the stresses applied to the expandable arm during operation. The mounting lug 22 includes a base 22*a* having a curved under surface at 22*b* which is adapted to complement and receive the curved end portion of the yokes 18*b* and 18*c* of the arm 18. The lug 22 further includes an upper section 22*c* which includes openings to receive suitable mounting bolts for mounting the lug 22 in the body 10 against radial shoulders 11*c* and 11*e* and longitudinal face 11*d*. In this manner, the mounting lug 22 is mounted into the upper portion of each of the openings such as 10*g* by suitable mounting bolts or set screws and provides curved under surfaces 22*b* to bear the major pressure transmitted through the expandable cutting arms during operation, thus taking a great deal of the stress that would otherwise be applied to the hinge pins 19*a*. The mounting lugs 22 further include a bore 22*d* which receives the body nozzle 25*b* to be described hereinafter.

Referring to FIGS. 1B and 3, side plate 31 is mounted against side 11*b* of each of the openings such as 10*g*. The side plate 31 is basically a rectangular member having a tang at its lower end providing a limit edge 31*a*. Side plate 31 has an opening 31*b* through which the hinge pin 19*a* extends and further includes a mounting recess 31*c* for receiving a set screw or bolthead which extends through an opening in the recess 31*c* into the body 10. Each of the expandable arms such as 18 includes a limit ledge 18*k*, shown in FIG. 1B, which bears against the limit edge 31*a* of the tang of side plate 31 when the operating arm is expanded to the desired outer or expanded position. In this manner, expansion of the outer arm to a particular outer position can be controlled thereby controlling and predetermining the outer diameter to which the tool is to enlarge the borehole.

The arm 18 includes a central bore 18*f* which extends from the U-shaped recess 18*d* to end face 18*g*. A nozzle insert 18*h* is fitted into the face 18*g* in order to reduce the area of exit to provide higher velocity to the exiting fluid. The arm 18 further includes an interior cam recess 18*i* having a sloping camming surface 18*j*.

Referring to FIGS. 1A and 1B, a piston means generally designated as 23 is mounted in the main body bore 10*a* for movement between an initial position (bottom half of FIGS. 1A and 1B) and an actuated position (top half of FIGS. 1A and 1B) in which the piston means engages each of the expandable arms 16–18 and holds them in an expanded, operating position. The piston means 23 includes a tubular piston member 23*a* having an upper, actuating end 23*b* which exposes pressure face 23*c* to the pressure of the drilling fluid flowing through the tool in the direction of arrow 24. The piston member is a generally cylindrical member having an interior bore 23*d* which allows drilling fluid to be passed through the tool. The piston member 23*a* terminates in a piston flow restrictor 23*e* which is also generally cylindrical and includes an upper end which is welded or otherwise attached to the bottom 23*f* of the piston member. The flow restrictor 23*e* terminates in a bottom circular piece 23*g* having one or more openings 23*h* therein in order to allow the passage of the downwardly flowing drilling fluid outwardly through the remainder of the tool body bore. The cap or flow restrictor 23*e* thus also acts to provide an upper surface to cooperate with the upper face 23*c* of the piston member 23*a* to provide a pressure sensitive surface for the flowing drilling fluid to act against to move the piston member from its initial position shown in the bottom part of FIGS. 1A and 1B to the actuated position shown in the upper part of FIGS. 1A and 1B. Additionally, a series of four ports 26 are machined through the cylindrical portion of the bottom piston restrictor 23*e* in order to allow fluid to flow outwardly into the side body openings 10*e*, *f*, and *g*. Outward flow through the openings 26 in the piston member in the actuated position serve to direct additional fluid radially outwardly through the openings 10*e*, *f*, and *g* and serve to aid in the cleaning of the area around the operating expanded arms 16–18 in order to aid in preventing clogging of the area.

A position biasing sleeve 27 is also generally cylindrical in configuration and is mounted into the body bore 10*a* on body ledge 10*h*. The position biasing sleeve 27 is held in position by retainer ring 27*a*. Suitable dual seals 27*c* are mounted in grooves in the upper part of the position biasing sleeve 27 in order to prevent fluid flow between the sleeve and the interior wall 10*b* of the body 10. The piston member 23*a* is mounted for longitudinal movement inside of the position biasing sleeve 27 and has a downwardly facing circumferential shoulder 23*i* which cooperates with the position biasing sleeve 27 to provide an annular area 29 in which the spring 28 is mounted. The spring 28 acts against the piston circumferential shoulder 23*i* to bias the piston member 23 toward the initial position illustrated in the bottom part of FIGS. 1A and 1B and holds the piston member 23*a* in that position until sufficient pressure is applied against upper face 23*c* of the piston member 23 and the upper face of the bottom restrictor 23*e* to overcome the resilient biasing force of the spring and move the piston to its down, actuated position illustrated in the upper part of FIGS. 1A and 1B. A suitable wear ring is mounted in a circumferential recess in the piston upper part in order to engage the interior cylindrical wall 27*d* of the position sleeve to reduce wear in a known manner. A circumferential seal 23*k* is mounted in a recess near the upper face 23*c* of the piston member 23*a* in order to prevent the passage of fluid between the inner cylindrical wall 27*d* of the position sleeve and the outer wall of the piston member so that the piston member 23*a* will respond to fluid pressure.

The piston member 23*a* has mounted at its lower end 23*f* on the outside the piston cam 30 which is threadedly mounted onto the end of the piston member and held in position against a shoulder 23*n* on the exterior of the piston member 23*a*. The cam 30 acts against the camming surface 18*j* on the expandable arms 16–18 to move the expandable arms to the expanded position in response to fluid pressure.

The rotary fluid transfer means 25 is mounted substantially in the first or inner end 18*a* of each of the expandable arms such as 18 about the hinge pin 19*a* in fluid communication with each of the directional chambers or bores 12*e–g* of the body 10 and is also in fluid communication with each of the longitudinally extending bores 18*f* in the expandable arms 18. The rotary fluid transfer means 25 provides for the transfer of drilling fluid or other fluid from the main body bore 10*a* through the directional chambers 12*e–g* and through the rotary fluid transfer means 25 mounted with each of the expandable arms and through the bores 18*f* in each of the expandable arms such as 18 so that fluid is directed outwardly at the arm outer face 18*g* of each expandable arm to keep the cutting surface free of clogging during operation.

The rotary fluid transfer means 25 basically includes an approximately rectangular housing 25*a* having mounted therein a body nozzle 25*b* and an expandable arm nozzle 25*c*. The housing 25*a* is a substantially rectangular body having a cylindrical opening or bore therein formed by cylindrical interior wall 25*d*. The cylindrical interior wall 25*d* has a body nozzle opening 25*e* in which the body nozzle 25*b* is mounted and a second, oblong opening 25*f* through which the expandable arm nozzle 25*c* extends.

The body nozzle 25*b* is a tubular member having a recess in its outer end for holding an O-ring seal 25*g* (FIG. 1B). Similarly, the expandable arm nozzle 25*c* has a recess holding an O-ring seal 25*h* (FIG. 1B). Rotary mount means generally designated as 25*j* are mounted within the rotary transfer fluid housing 25*a* for mounting the expandable arm nozzle 25*c* for relative rotational movement with respect to the body nozzle 25*b*.

The rotary mount means 25*j* is a substantially cylindrical rotor member having a cylindrical outside surface on which a seal means 25*m* is mounted. The seal means 25*m* is any suitable, seal material which can be made to adhere to the exterior cylindrical surface of the rotor 25*j* and is sufficiently smooth to allow rotation of the rotor within the housing 25*a*. The rotor member 25*j* is thus mounted for rotation on the wall 25*d* within the housing 25*a*. Rotor member 25*j* includes an opening 25*n* having mounted therein the expandable arm nozzle 25*c* such that the expandable arm nozzle is mounted for rotation with the rotor, which rotates with respect to the housing member 25*a*. A side plate 25*p* mounts against one side of housing 25*a* opposite to side 25*o* of the housing 25*a*. The side 25*o* is an integral part of the housing 25*a*. Each of the side plates includes an interior O-ring seal retainer portion designated as 25*q* (see FIG. 2 also) at an opening in the side plate in order to receive the hinge pin 19*a* and prevent the passage of fluid between the hinge pin and the assembled full housing 25*a*. In this manner, the chamber within the housing 25*a* is sealed and receives the hinge pin such that the chamber is sealed for the passage of fluid from the body nozzle 25*b* through the housing chamber around the partially enclosed pin 19*a* and into and through the expandable arm nozzle 25*c*.

The foregoing disclosure and description of the invention are illustrative and explanatory thereof, and various changes in the size, shape and materials, as well as in the details of the illustrated construction may be made without departing from the spirit of the invention. For example, the apparatus of this invention has been described as either an underreamer or milling tool. However, the novel features have application in any tools wherein it is necessary to provide effective fluid circulation to movable arms.

We claim:

1. Apparatus for performing operations in an oil well drilling borehole or other borehole, comprising:

an elongated generally cylindrical body having a main bore there through, said body having a plurality of lateral openings therein;

said body having a plurality of circumferentially spaced directional chambers which extend between said main bore and said plurality of lateral openings;

a plurality of expandable arms, each arm having a first end and a second, operating end having an operating surface or element thereon for engaging the side of a borehole and performing an operation thereon;

pivot means mounted with said body and with said first end of said expandable arms for mounting each of said plurality of expandable arms in one of said lateral body openings for movement between a closed position in which said arm is positioned in said lateral body opening and second, expanded operating position in which said operating end of said arm engages said borehole;

means for engaging said plurality of expandable arms and holding said expandable arms in an operating position;

each of said expandable arms having a bore therein, which bore extends from said first end of said expandable arm and terminates at said second operating end;

a rotary fluid transfer means for each expandable arm, each of said rotary fluid transfer means being mounted with said body in fluid communication with one of said circumferentially spaced directional chambers and with said first end of said expandable arm substantially surrounding said pivot means for directing fluid from said one directional chamber to said bore in said expandable arm for directing fluid outwardly of said expandable arm.

2. The structure set forth in claim 1, wherein said rotary fluid transfer means includes:

a body nozzle mounted with said expandable arm and being mounted in fluid communication with one of said directional chambers of said body.

3. The structure set forth in claim 2, wherein said rotary fluid transfer means includes:

an expandable arm nozzle mounted in fluid communication with said bore in said expandable arm.

4. The structure set forth in claim 3, wherein said rotary fluid transfer means includes:

a fluid transfer housing mounted with said first end of said expandable arm and having mounted therein said body nozzle and expandable arm nozzle for transferring fluid from said directional chamber in said body to said bore in said expandable arm.

5. The structure set forth in claim 4, wherein said rotary fluid transfer housing includes:

rotary mount means positioned with said fluid transfer housing for mounting said expandable arm nozzle for relative rotational movement with respect to said body nozzle.

6. The structure set forth in claim 4, wherein said rotary fluid transfer means includes:

said fluid transfer housing having said body nozzle attached to said housing;

said fluid transfer housing having a substantially cylindrical internal wall portion;

a rotary fluid transfer element being mounted within said housing for rotation around said cylindrical internal wall portion; and said expandable arm nozzle being attached to said rotary fluid transfer element for movement of said expandable arm nozzle with said rotary fluid transfer element for rotation with respect to said housing.

7. The structure set forth in claim 6, including:

said rotary fluid transfer element having a substantially cylindrical surface which is complementary to said substantially cylindrical internal wall portion of said fluid transfer housing; and seal means mounted on said substantially cylindrical surface of said fluid transfer element for engaging said cylindrical wall portion of said fluid transfer housing.

8. The structure set forth in claim 7, including:

said seal means mounted on said substantially cylindrical surface of said rotary fluid transfer element sealably engaging said cylindrical wall portion of said fluid transfer housing.

9. The structure set forth in claim 8, including:

said pivot means is a hinge pin mounted with said body and extending through said first end of said expandable arm; said hinge pin extending through said side plates and through said rotary fluid transfer element.

10. The structure set forth in claim 1, wherein:

said pivot means is a hinge pin which extends through said first end of said expandable arm and is mounted with said body; and said rotary fluid transfer means is mounted substantially in said first end of said expandable arm and said hinge pin extends through said rotary fluid transfer means.

11. The structure set forth in claim 1, wherein:

said body includes a thrust lug which is mounted with said body, said thrust lug having a bore therein;

said rotary fluid transfer means includes, a body nozzle mounted with said housing and being mounted in fluid communication with said directional chamber of said body;

an expandable arm nozzle mounted in fluid communication with said bore in said expandable arm;

a fluid transfer housing mounted with said first end of said expandable arm and having mounted therein said body nozzle and expandable arm nozzle for transferring fluid from said directional chamber in said body to said bore in said expandable arm.

12. The structure set forth in claim 11, wherein said fluid transfer housing further includes:

rotary mount means positioned with said fluid transfer housing for mounting said expandable arm nozzle for relative rotational movement with respect to said fluid transfer housing and said body nozzle.

* * * * *